US007523939B1

(12) United States Patent
Campbell et al.

(10) Patent No.: US 7,523,939 B1
(45) Date of Patent: Apr. 28, 2009

(54) REMEMBRANCE GAME SYSTEM

(76) Inventors: Michael Campbell, 2619 East Cherokee Rd., Stockton, CA (US) 95205; Sherry Campbell, 2619 East Cherokee Rd., Stockton, CA (US) 95205

( * ) Notice: Subject to any disclaimer, the term of this patent is extended or adjusted under 35 U.S.C. 154(b) by 26 days.

(21) Appl. No.: 11/687,382

(22) Filed: Mar. 16, 2007

(51) Int. Cl.
*A63F 3/00* (2006.01)

(52) U.S. Cl. ..... 273/243; 273/153 R; 273/430

(58) Field of Classification Search ..... 273/243, 273/430, 157, 253 R, 156, 157 R
See application file for complete search history.

(56) References Cited

U.S. PATENT DOCUMENTS 3,468,540 A * 9/1969 Mulligan ..... 273/256
D245,278 S 8/1977 Martin, Jr. et al.
4,081,183 A 3/1978 Urban
4,234,186 A 11/1980 Forrest et al.
4,629,431 A * 12/1986 Sanders ..... 434/304
5,190,293 A 3/1993 Cabrera
6,481,714 B1 11/2002 Jacobs
2003/0085579 A1 5/2003 Seksaria et al.

FOREIGN PATENT DOCUMENTS

GB 2218001 A * 11/1989

* cited by examiner

*Primary Examiner*—Vishu K. Mendiratta

(57) ABSTRACT

A remembrance game system for helping players playing to remember a deceased friend or family member includes a plurality of puzzle pieces being assembled to reveal a picture of a loved one and a plurality of player tokens. A game board is positionable on a support surface. The game board has a path indicated thereon. The path is divided into a plurality of spaces. The spaces include a plurality of action spaces to indicate an action to be performed by a player when one of the player tokens is positioned on one of the action spaces. The spaces include a plurality of character spaces to indicate receiving of one of the puzzle pieces when one of the player tokens is positioned on one of the character spaces. At least one die is rolled to indicate movement characteristics of the player tokens.

2 Claims, 8 Drawing Sheets

REMEMBRANCE GAME SYSTEM

BACKGROUND OF THE INVENTION

1. Field of the Invention

The present invention relates to board games and more particularly pertains to a new board game for helping players playing to remember a deceased friend or family member.

2. Description of the Prior Art

The use of board games is known in the prior art. While these devices fulfill their respective, particular objectives and requirements, the need remains for a system and method that has certain improved features that allow players to work together to remember a deceased friend or family member. Additionally, the system should require that all the players finish the game at the same time.

SUMMARY OF THE INVENTION

The present invention meets the needs presented above by generally comprising a plurality of puzzle pieces being assembled to reveal a picture of a loved one and a plurality of player tokens. A game board is positionable on a support surface. The game board has a path indicated thereon. The path is divided into a plurality of spaces. The spaces include a plurality of action spaces to indicate an action to be performed by a player when one of the player tokens is positioned on one of the action spaces. The spaces include a plurality of character spaces to indicate receiving of one of the puzzle pieces when one of the player tokens is positioned on one of the character spaces. At least one die is rolled to indicate movement characteristics of the player tokens.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
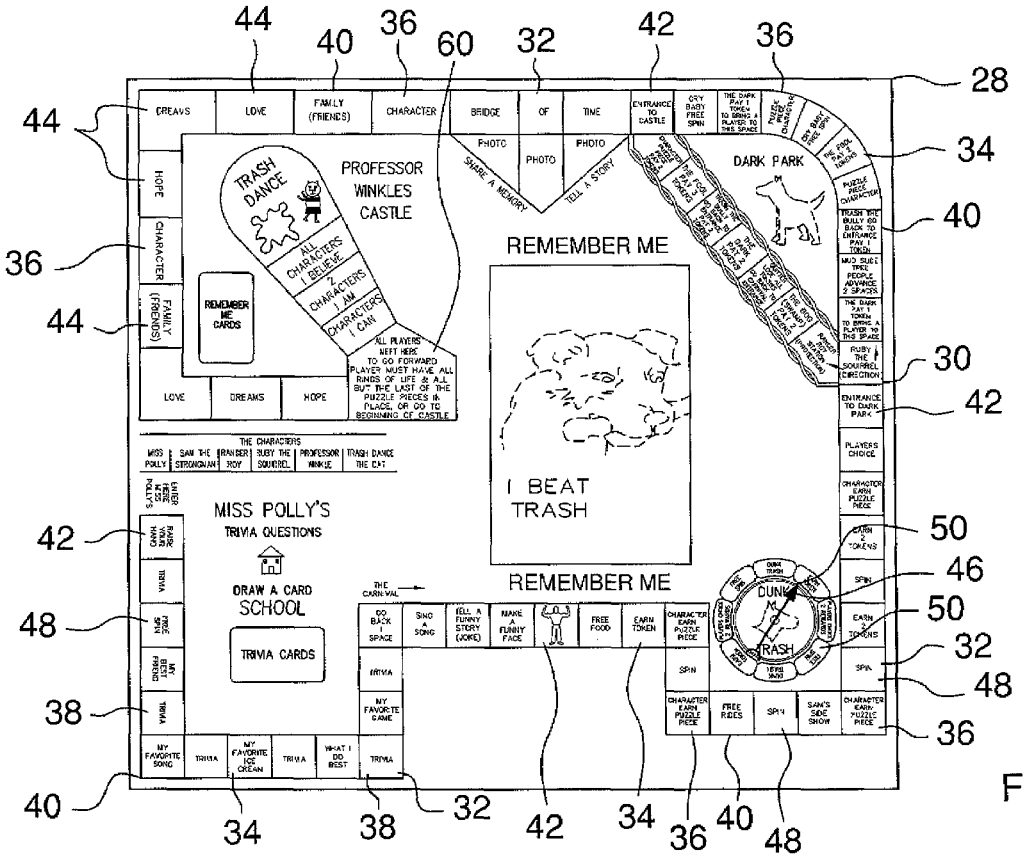
FIG. 1 is a top view of a game board a remembrance game system according to the present invention.
Figure 2:
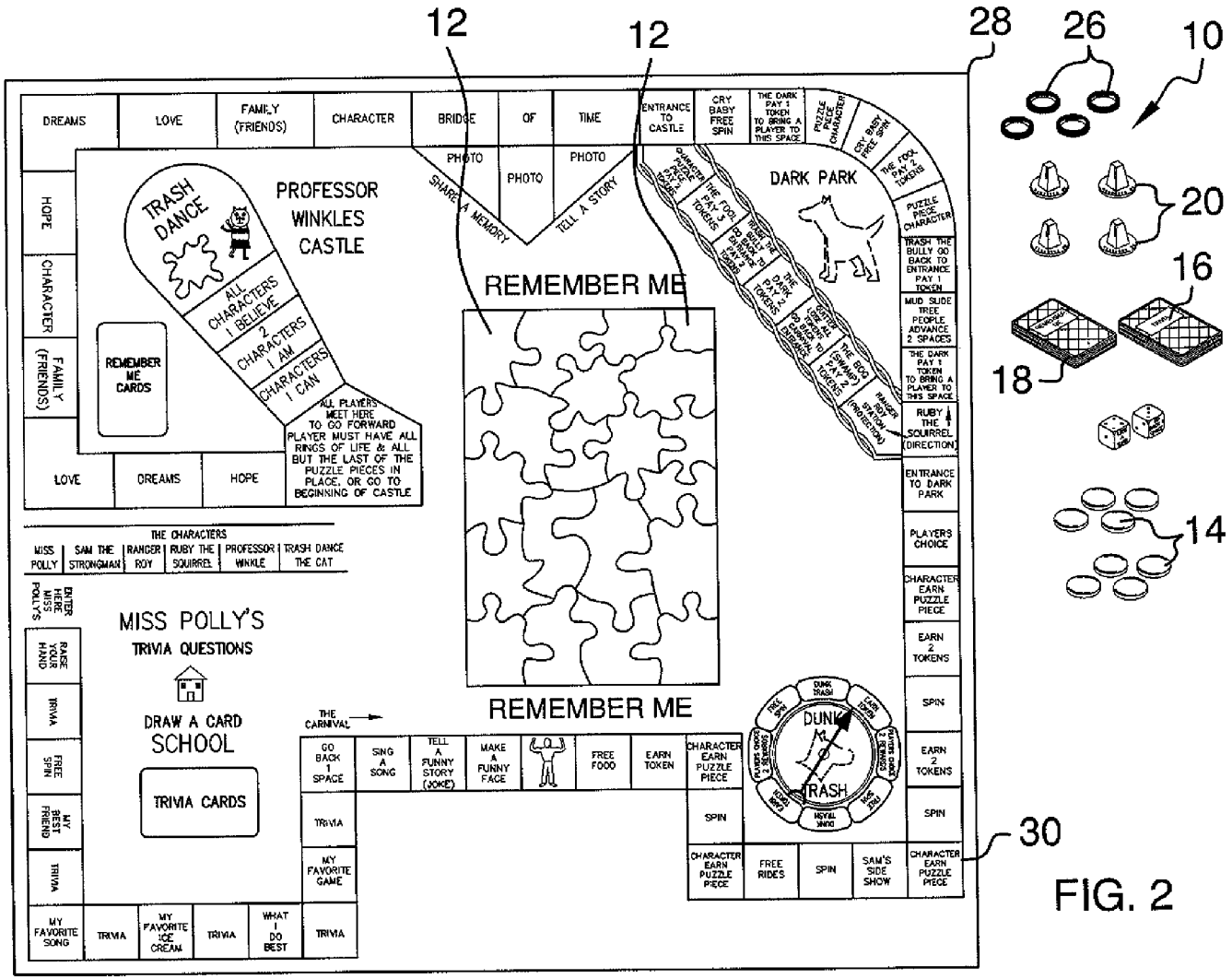
FIG. 2 is a top perspective view of the present invention.
Figure 3:
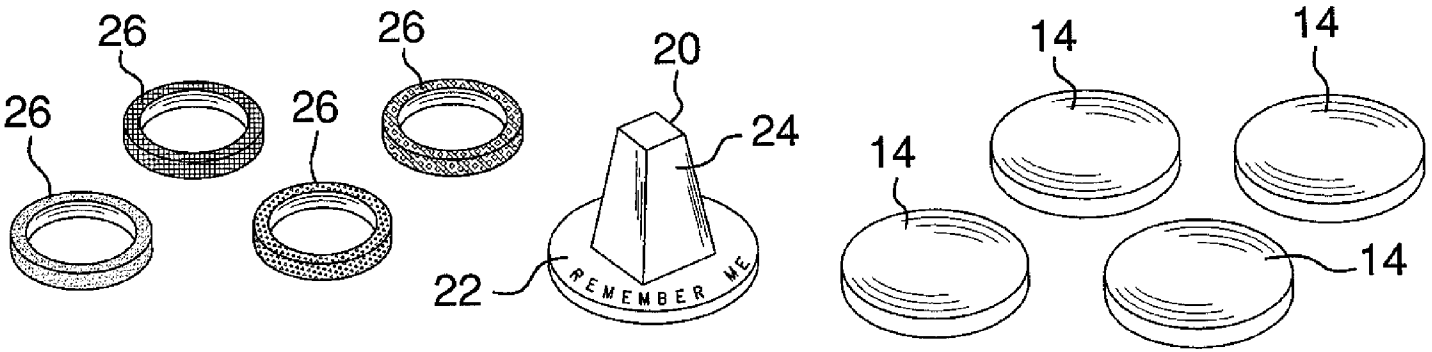
FIG. 3 is a perspective view of the ring tokens, the reward tokens and one of the player tokens of the present invention.
Figure 4:
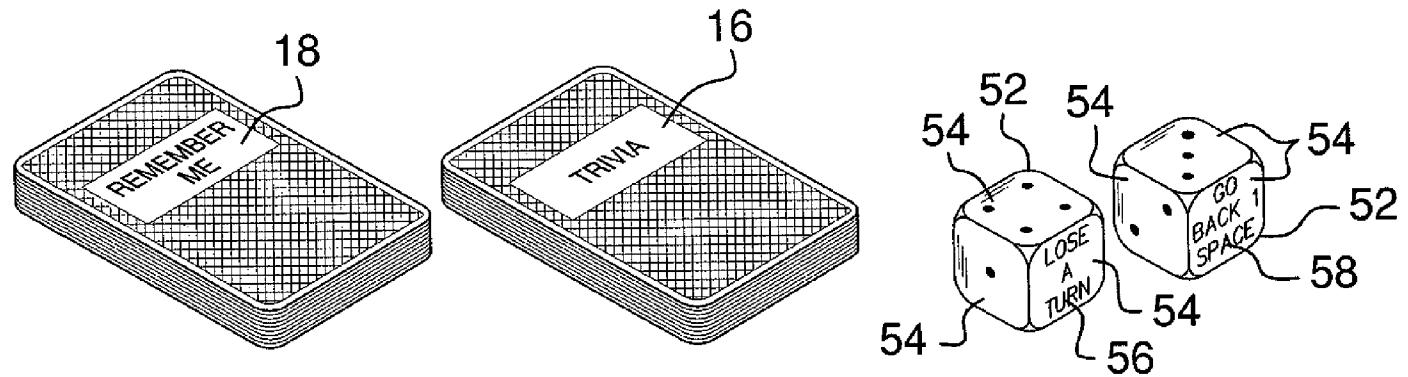
FIG. 4 is a perspective view of the trivia cards, the remembrance cards and the at least one die of the present invention.
Figure 5:
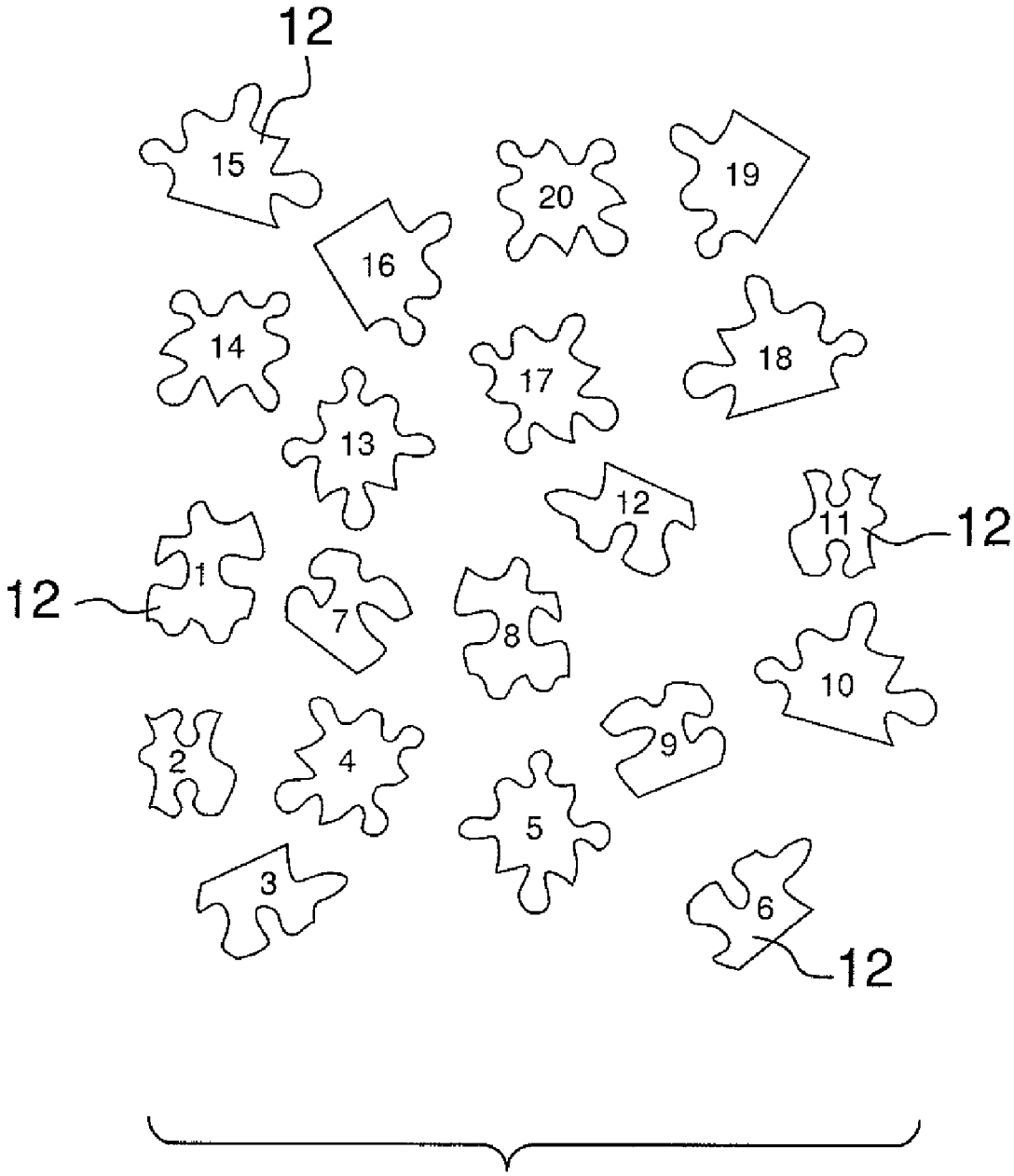
FIG. 5 is a top view of the puzzle pieces of the present invention.
Figure 6:
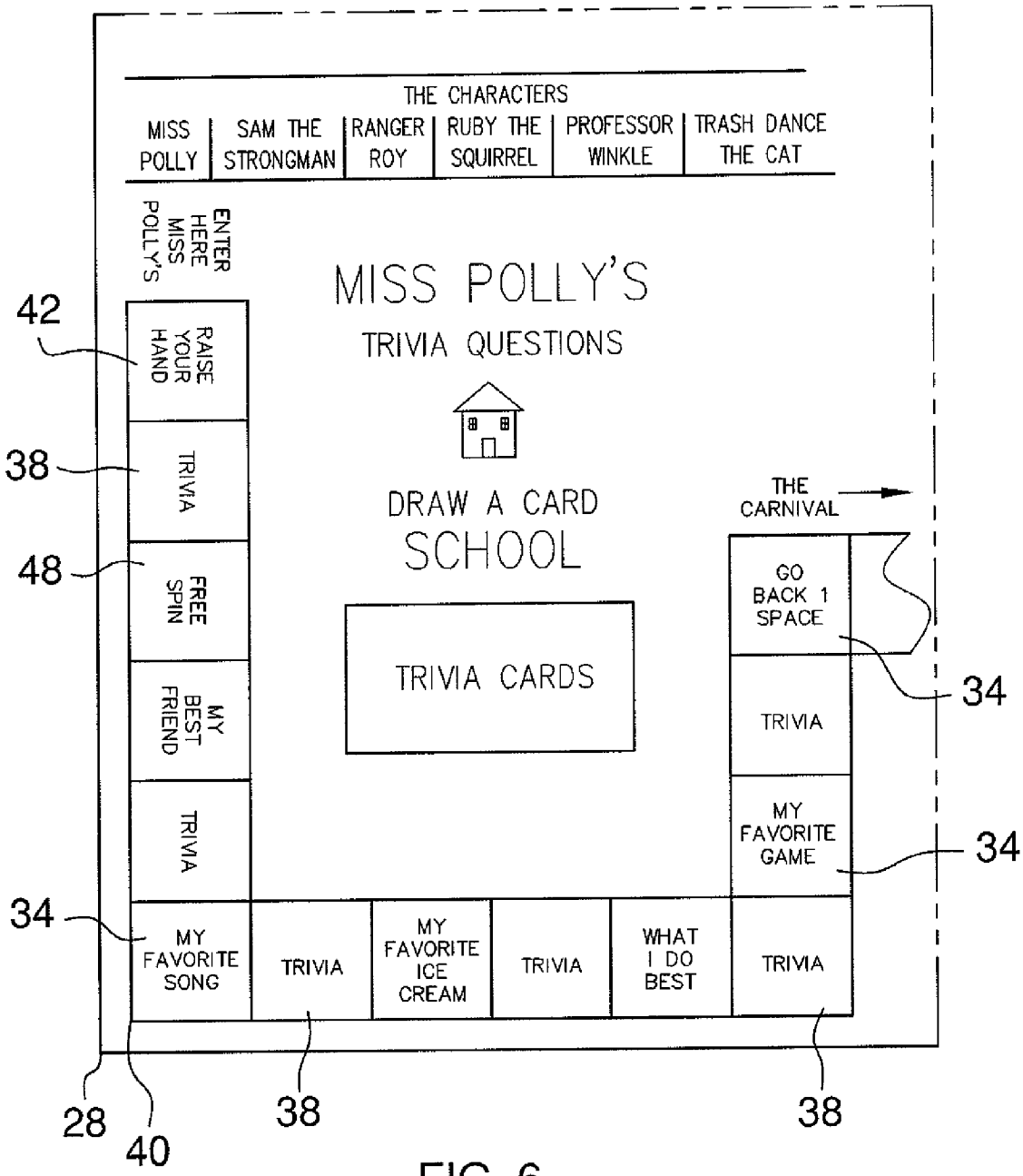
FIG. 6 is an enlarged top view of one of the theme sections of the present invention.
Figure 7:
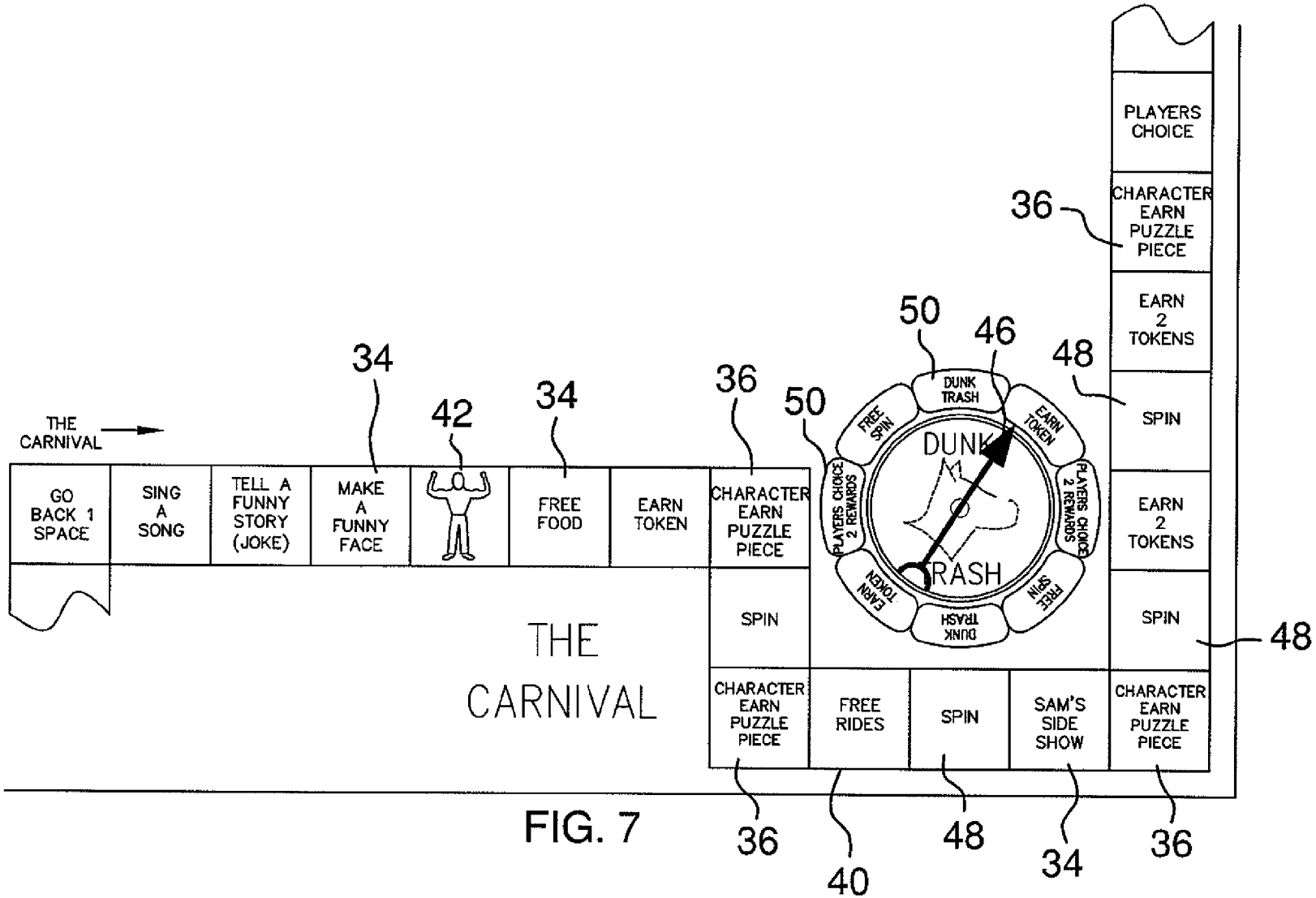
FIG. 7 is an enlarged top view of another one of the theme sections of the present invention.
Figure 8:
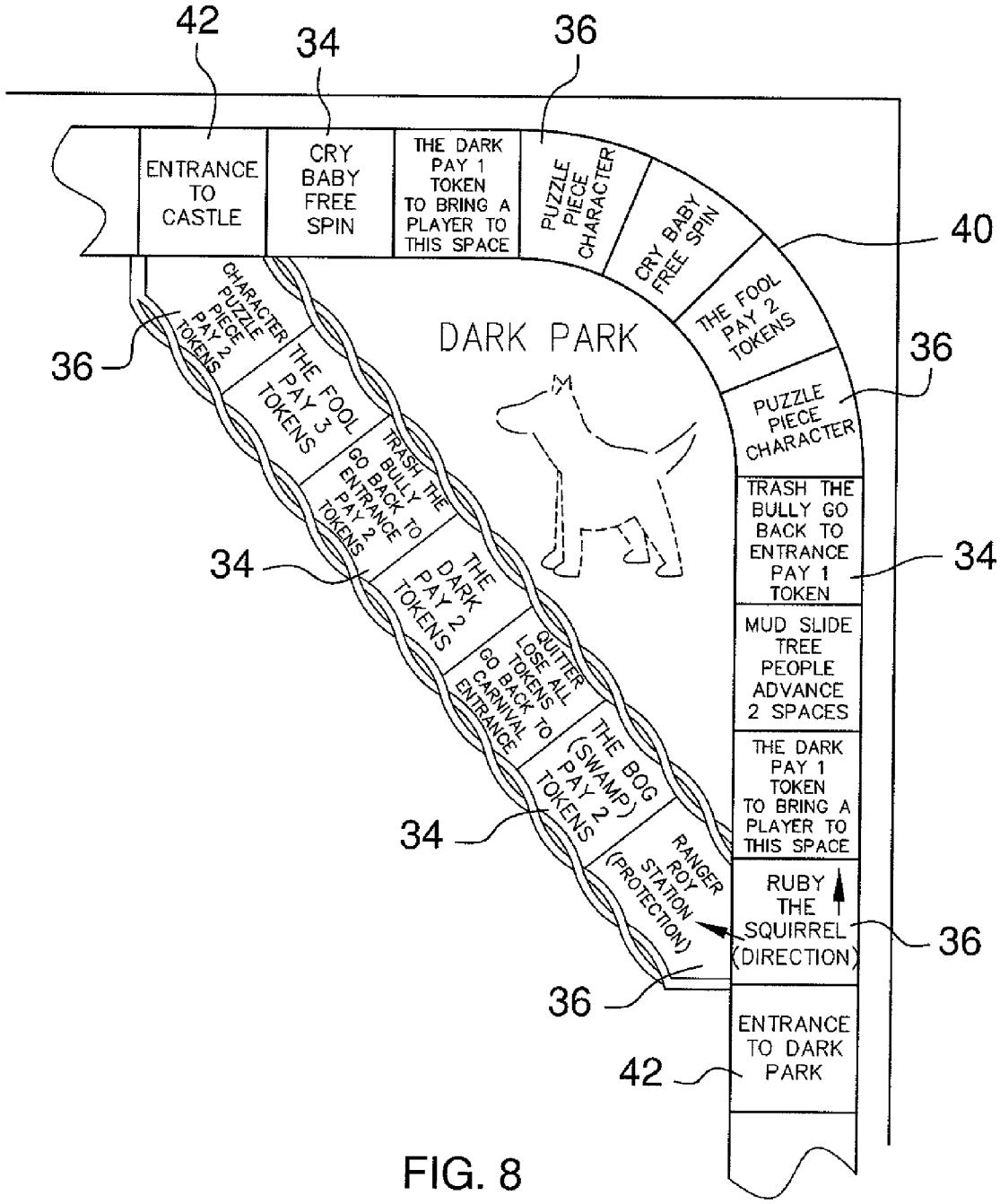
FIG. 8 is an enlarged top view of another one of the theme sections of the present invention.
Figure 9:
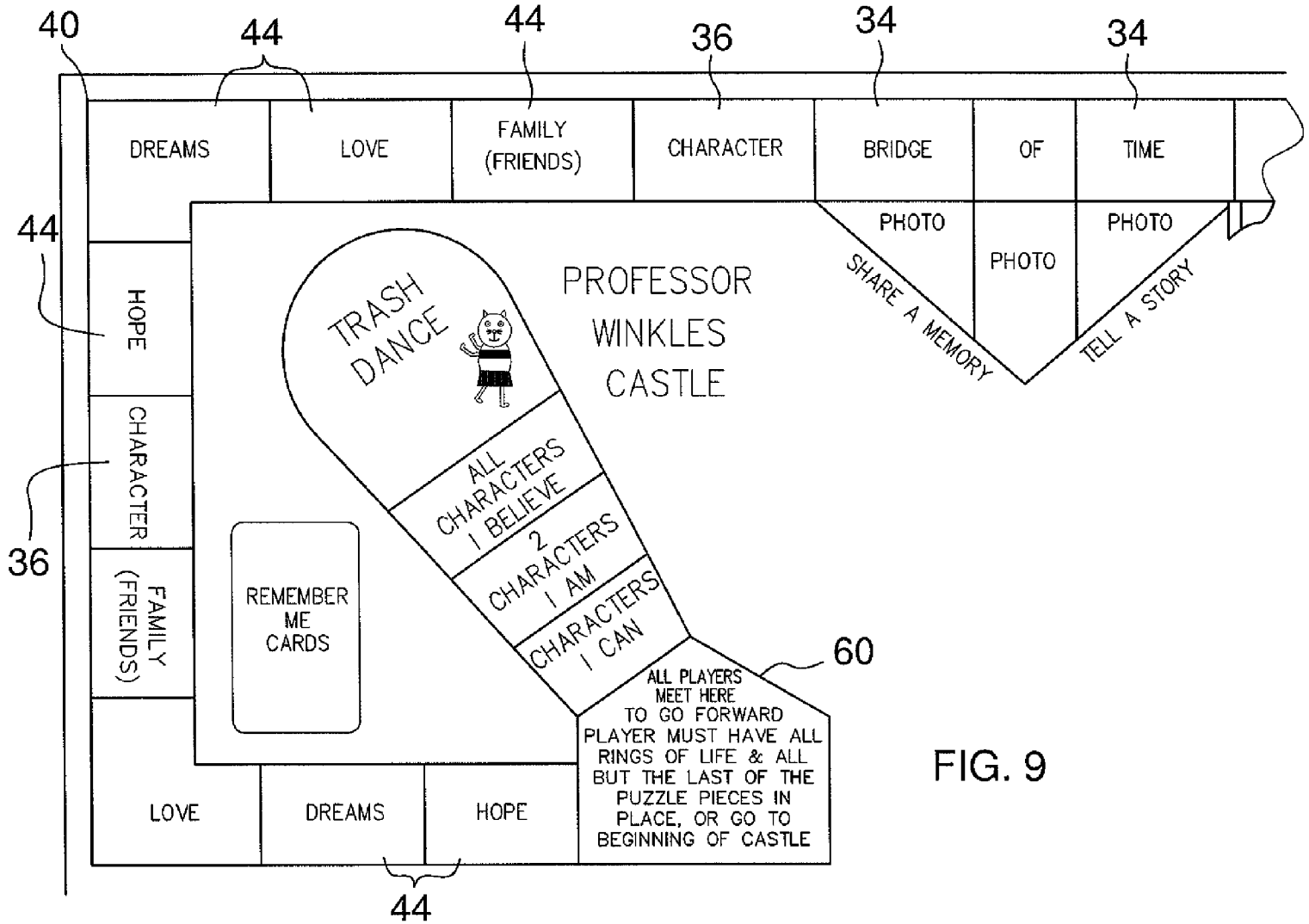
FIG. 9 is an enlarged top view of another one of the theme sections of the present invention.

With reference now to the drawings, and in particular to FIGS. 1 through 9 thereof, a new board game embodying the principles and concepts of the present invention and generally designated by the reference numeral 10 will be described.

As best illustrated in FIGS. 1 through 9, the remembrance game system 10 generally comprises a plurality of puzzle pieces 12 being assembled to reveal a picture of a loved one. Also included are a plurality of reward tokens 14, a plurality of trivia cards 16, a plurality of remembrance cards 18 and a plurality of player tokens 20. Each of the player tokens 20 includes a base plate 22 and a column 24 extending upwardly from the base plate 22. The column 24 of each of the player tokens 20 extends through at least one of a plurality of ring tokens 26 to position the ring tokens 26 on the base plate 22 of the associated one of the player tokens 20.

A game board 28 is positionable on a support surface. The game board 28 has a path 30 indicated thereon. The path 30 is divided into a plurality of spaces 32. The spaces 32 include a plurality of action spaces 34 to indicate an action to be performed by a player when one of the player tokens 20 is positioned on one of the action spaces 34. The spaces 32 include a plurality of character spaces 36 to indicate receiving one of the puzzle pieces 12 when one of the player tokens 20 is positioned on one of the character spaces 36. Each of the character spaces 36 may include written indicia or picture indicia. The spaces 32 include a plurality of trivia spaces 38 indicating drawing of one of the trivia cards 16 when one of the player tokens 20 is positioned on one of the trivia spaces 38.

The path 30 of the game board 28 is divided into a plurality of theme sections 40. The spaces 32 of each of the theme sections 40 include an entrance space 42 to indicate entering of the associated one of the theme sections 40. The spaces 32 of a last one of the theme sections 40 includes a plurality of ring spaces 44 to indicate receiving one of the ring tokens 26 when one of the player tokens 20 is positioned on one of the ring spaces 44.

A spinner 46 is rotatably mounted to the game board 28. The spaces 32 include a plurality of spin spaces 48 to indicate spinning of the spinner 46 by one of the players when an associated one of the player tokens 20 is positioned on one of the spin spaces 48. The spinner 46 is spun to point to one of a plurality of reward spaces 50.

At least one die 52 is rolled to indicate movement characteristics of the player tokens 20. The at least one die 52 includes a plurality of faces 54. Four of the faces 54 are numbered 1 through 4 to indicate a number of spaces 32 to be moved. One of the faces 54 has a turn indicia 56 to indicate a loss of a turn. One of the faces 54 has a back indicia 58 to indicate a number of spaces 32 an associated one of the player tokens 20 are moved backwards.

The theme sections 40 include a school theme containing the trivia spaces 38. The theme sections 40 also include a carnival theme. The theme sections 40 include a dark park theme where the players get to choose one of a plurality of paths. The theme sections 40 additionally include a castle section that includes the ring spaces 44 and includes the distribution of the remembrance cards 18 to the players.

In use, each of the players selects one of the player tokens 20 and places the player tokens 20 on the entrance space 42 of a first one of the theme sections 40. One of the players is chosen to go first and one of the players is chosen to read the trivia cards 16, to handle the reward tokens 14 and the ring tokens 26. The at least one die 52 is rolled by each of the players in turn and the associated one of the player tokens 20 is moved along the path 30 as indicated on the at least one die 52. The indicated action is performed by one of the players when the associated one of the player tokens 20 stops on one of the action spaces 34. Each of the action spaces 34 is to help the players to remember the person that is depicted on the puzzle pieces 12.

One of the trivia cards 16 is read and answered when one of the player tokens 20 lands on one of the trivia spaces 38 of a first one of the theme sections 40. The player required to answer the one of the trivia cards 16 can be assisted by the other players. One of the reward tokens 14 or one of the puzzle pieces 12 is rewarded to the player of the associated one of the player tokens 20 positioned on the trivia spaces when the trivia card 16 is correctly answered. The spinner 46 is spun by one of the players when an associated one of the player tokens 20 is positioned on one of the spin spaces 48 and the player is rewarded with a reward shown on the designated one of the reward spaces 50.

One of the puzzle pieces 12 is rewarded to one of the players when the associated one of the player tokens 20 is positioned on one of the character spaces 36. The puzzle pieces 12 are assembled by the players when the players receive the puzzle pieces 12. One of the remembrance cards 18 is giving to one of the players when the associated one of the player tokens 20 is positioned on character spaces 36 in the last one of the theme sections 40 when all but the last one of the puzzle pieces 12 has been assembled. One of the ring tokens 26 is given to one of the players when the associated one of the player tokens 20 is positioned on one of the ring spaces 44.

The player tokens 20 are gathered on a meeting space 60 of the last one of the theme sections 40 when the players have collected all of the ring tokens 26 and all but the last one of the puzzle pieces 12. If all the ring tokens 26 or all but the last one of the puzzle pieces 12 have not been collected the player tokens 20 are moved to the entrance space 42 of the last one of the theme sections 40. If all the ring tokens 26 and all but the last one of the puzzle pieces 12 has been collected the players with player tokens 20 in the meeting space may roll the at least one die 52 and give the subsequent movement characteristics to another player to further that player further along the path 30 or collect one of the remembrance cards 18. Each of the player tokens 20 is advanced together one space at a time each turn towards an end of the path 30. The game is ended and the last one of the puzzle pieces 12 is awarded when all of the player tokens 20 reach an end of the path 30.

With respect to the above description then, it is to be realized that the optimum dimensional relationships for the parts of the invention, to include variations in size, materials, shape, form, function and manner of operation, assembly and use, are deemed easily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A remembrance game system comprising:

a plurality of puzzle pieces being assembled to reveal a picture of a loved one;

a plurality of reward tokens;

a plurality of trivia cards;

a plurality of remembrance cards;

a plurality of player tokens, each of said player tokens including a base plate and a column extending upwardly from said base plate;

a plurality of ring tokens, said column of each of said player tokens extending through at least one of said ring tokens to position said ring tokens on said base plate of the associated one of said player tokens;

a game board being positionable on a support surface, said game board having a path indicated thereon, said path being divided into a plurality of spaces, said spaces including a plurality of action spaces indicating an action to be performed by a player when one of said player tokens is positioned on one of said action spaces, said spaces including a plurality of character spaces indicating receiving one of said puzzle pieces when one of said player tokens is positioned on one of said character spaces, said spaces including a plurality of trivia spaces indicating drawing of one of said trivia cards when one of said player tokens is positioned on one of said trivia spaces, said path being divided into a plurality of theme sections, said spaces of each of said theme sections including an entrance space to indicate entering of the associated one of said theme sections, said spaces of a last one of said theme sections including a plurality of ring spaces to indicate receiving one of said ring tokens when one of said player tokens is positioned on one of said ring spaces;

a spinner being rotatably mounted to said game board, said spaces including a plurality of spin spaces to indicate spinning of said spinner by one of the players when an associated one of said player tokens is positioned on one of said spin spaces, said spinner pointing to one of a plurality of reward spaces when said spinner is spun; and at least one die being rolled to indicate movement characteristics of said player tokens, said at least one die including a plurality of faces, four of said faces being numbered 1 through 4 to indicate a number of spaces to be moved, one of said faces having a turn indicia to indicate a loss of a turn, one of said faces having a back indicia to indicate a number of spaces an associated one of said player tokens are moved backwards.

2. A method of playing a game comprising:

providing a remembrance game system comprising:

a plurality of puzzle pieces being assembled to reveal a picture of a loved one;

a plurality of reward tokens;

a plurality of trivia cards;

a plurality of remembrance cards;

a plurality of player tokens, each of said player tokens including a base plate and a column extending upwardly from said base plate;

a plurality of ring tokens, said column of each of said player tokens extending through at least one of said ring tokens to position said ring tokens on said base plate of the associated one of said player tokens;

a game board being positionable on a support surface, said game board having a path indicated thereon, said path being divided into a plurality of spaces, said spaces including a plurality of action spaces indicating an action to be performed by a player when one of said player tokens is positioned on one of said action spaces, said spaces including a plurality of character spaces indicating receiving one of said puzzle pieces when one of said player tokens is positioned on one of said character spaces, said spaces including a plurality of trivia spaces indicating drawing of one of said trivia cards when one of said player tokens is positioned on one of said trivia spaces, said path being divided into a plurality of theme sections, said spaces of each of said theme sections including an entrance space to indicate entering of the associated one of said theme sections, said spaces of a last one of said theme sections including a plurality of ring spaces to indicate receiving one of said ring tokens when one of said player tokens is positioned on one of said ring spaces;

a spinner being rotatably mounted to said game board, said spaces including a plurality of spin spaces to indicate spinning of said spinner by one of the players when an associated one of said player tokens is positioned on one of said spin spaces, said spinner pointing to one of a plurality of reward spaces when said spinner is spun;

at least one die being rolled to indicate movement characteristics of said player tokens, said at least one die including a plurality of faces, four of said faces being numbered 1 through 4 to indicate a number of spaces to be moved, one of said faces having a turn indicia to indicate a loss of a turn, one of said faces having a back indicia to indicate a number of spaces an associated one of said player tokens are moved backwards;

selecting by each of the players one of said player tokens and placing of said player tokens on said entrance space of a first one of said theme sections;

choosing of one of said players to go first and one of said players to read trivia cards, to handle said reward tokens and said ring tokens;

rolling of said at least one die by each of the players in turn and moving the associated one of said player tokens along said path as indicated on said at least one die;

performing the indicated action by one of the players when the associated one of said player tokens stops on one of said action spaces;

reading and answering of one of said trivia cards when one of said player tokens lands on one of said trivia spaces of a first one of said theme sections;

rewarding of one of said reward tokens or one of said puzzle pieces to the player of the associated one of said player tokens positioned on said trivia spaces when said trivia card is correctly answered;

spinning of said spinner by one of the players when an associated one of said player tokens is positioned on one of said spin spaces and rewarding of the player with a reward shown on the designated one of said reward spaces;

rewarding of one of said puzzle pieces to one of the players when the associated one of said player tokens is positioned on one of said character spaces;

assembling of said puzzle pieces by the players when the players receive said puzzle pieces;

giving of one of said remembrance cards to one of the players when the associated one of said player tokens is positioned on a character spaces in the last one of said theme sections when all but the last one of said puzzle pieces has been assembled;

giving of one of said ring tokens to one of the players when the associated one of said player tokens is positioned on one of said ring spaces;

gathering said player tokens on a meeting space of the last one of said theme sections when the players have collected all of said ring tokens and all but the last one of said puzzle pieces;

each of said player tokens being advanced together one space at a time each turn towards an end of said path;

ending of said game and awarding of the last one of said puzzle pieces when all of said player tokens reach an end of said path.

* * * * *